United States Patent [19]

Palmer

[11] 3,990,247

[45] Nov. 9, 1976

[54] SYSTEM OF STRUCTURES TO RESIST HYDRODYNAMIC FORCES

[76] Inventor: Robert Q. Palmer, 410 Falcon Lane, Las Vegas, Nev. 89107

[22] Filed: Jan. 21, 1975

[21] Appl. No.: 542,788

Related U.S. Application Data

[63] Continuation-in-part of Ser. No. 426,122, Dec. 19, 1973, abandoned.

[52] U.S. Cl. ..... 61/4; 61/37

[51] Int. Cl.[2] ..... E02B 3/04; E02B 3/14

[58] Field of Search ..... 61/4, 3, 5, 37, 38

[56] References Cited

UNITED STATES PATENTS

| | | | |
|---|---|---|---|
| 546,758 | 9/1885 | Bryant | 61/4 |
| 954,283 | 4/1910 | Hawkes | 61/4 |
| 1,597,114 | 8/1926 | Scott | 61/37 |
| 1,987,150 | 1/1935 | Mason | 61/37 |
| 2,652,692 | 9/1953 | Hayden | 61/4 |
| 3,096,621 | 7/1963 | Danel | 61/4 |
| 3,195,266 | 7/1964 | Onanian | 61/4 UX |
| 3,386,252 | 6/1968 | Nelson | 61/37 |
| 3,597,928 | 8/1971 | Pilaar | 61/4 X |

*Primary Examiner*—Dennis L. Taylor
*Attorney, Agent, or Firm*—Stevens, Davis, Miller & Mosher

[57] ABSTRACT

A protective armor layer for revetments which includes a plurality of components arranged in a close-fitting substantially uniformly patterned single layer for placement on an embankment with the axes of the components substantially perpendicular to the embankment and with a tie-rod through diagonal rows of the components at eyelets in the components. A component is comprised of a short cylindrical tube having a length of about one-half of the outside diameter and a wall thickness of about one-tenth the outside diameter.

10 Claims, 12 Drawing Figures

SYSTEM OF STRUCTURES TO RESIST HYDRODYNAMIC FORCES

This is a continuation-in-part application of U.S. Ser. No. 426,122 filed Dec. 19, 1973 now abandoned.

The invention relates to components for integration into stable-breakwaters, revetments and jetties exposed to waves, currents and oscillations of seas, lakes, streams and artificial channels.

It is common practice to use quarry stone of great weight for construction of armoring of revetments, breakwaters and jetties which will hereinafter be generically referred to as revetments.

In locations where suitable stone of sufficient weights and/or quality are not readily available, it has been the practice to use stone substitutes. Common substitutes for stone are layers of concrete blocks of various shapes and weights. Heavy blocks are used where the greatest hydrodynamic forces are anticipated. Where large magnitude forces are anticipated, use is made of blocks weighing many tons and such blocks are intricately interlocked. Some blocks are provided with vents to attenuate hydrodynamic uplift forces which tend to displace the blocks. If the interlocking is disturbed by greater than anticipated hydrodynamic forces, uplift forces exceeding the weight of the blocks or erosion undercutting the layer progressive failure of the layer of blocks occurs.

It is not practical to interlock blocks when the observation is obscured under turbid water and/or when waves or currents are strong. It is also impractical to install some types of very heavy blocks. Further, the complex shapes have inherent planes of weaknesses and are thus subject to breakage.

The manufacture of these concrete blocks of various shapes require complicted molds which are assembled and disassembled for the casting of each block, and a waiting period for partial curing of the concrete before all or parts of the forms can be completely removed.

An object of the present invention is to provide an improved revetment component which when integrated into an armor layer on the revetment will withstand the greatest indigineous hydrodynamic forces by virtue of mutual resistance rather than depend on the weight of each block or intricate interlocking.

Another object of the invention is to provide an improved revetment component which when integrated into an armor layer has six full height lines of contact with the six components in juxtaposition exerting mutually compressive forces to resist rolling of the component or otherwise being displaced from the armor layer.

Another object of the invention is to provide an improved revetment component which exposes a relatively small area to hydrodynamic uplift forces so that the total uplift forces are insufficient to displace it.

Another object of the invention is to provide an improved revetment component of tubular shape which provides an excess of venting capacity to minimize the forces which would otherwise tend to displace the component.

Another object of the invention is to provide an improved revetment component which can be easily manufactured with readily available machinery.

Another object of the invention is to provide an improved revetment component which can be easily integrated with other components into an articulated layer which would maintain its integrity if undermined by erosion.

Another objective of the invention is to provide an improved revetment component of proportionately greater height for use in irregular underlayers of stone rather than on a fairly smooth plane of cobbles or sandy material covered with filter cloth.

Another objective of the invention is to provide an improved revetment component which would have a very small part of solid material compared to the gross volume occasioned by the component.

Another object of the invention is to minimize the cost of producing revetment components and to attenuate wave runup by trapping much of the wave uprush in the voids in and between the components.

Another objective of the invention is to provide an improved concrete revetment component of tubular form which is thus subject only to compressive forces which are best resisted by concrete.

Additional objects and advantages of the present invention will be obvious to those skilled in the art as the description proceeds.

The revetment system of the present invention is comprised of an under layer on top of which are rings in contact with each other in which the height of the ring is no more than the outside diameter thereof and the thickness of the wall is about five-hundredths to about one-tenth of the outside diameter. This system provides a unique quality in its unprecedented high void percentage which exceeds 60 percent and may be as high as about of 64 to 81% of the volume of revetment. This high percentage of voids is accompanied by an unusually thin revetment layer of about half of the thickness of the armor layers of other known components. The combination of unusually high voids and a relatively thin armor layer reduces the quantity of concrete required in the revetment to about half of that required for other known systems.

The revetment system of the present invention reflects a stability co-efficient in excess of 25 and up to 45 which indicates the superior stability of this system over known systems. The procedures and formulas for determining the stability coefficient may be found in Shore Protection Manual, Chapter VII of the U.S. Army Coastal Engineering Research Center, 1973.

The following is taken from the Shore Protection Manual. Following work by Iribarren (1938, 1950), comprehensive investigations were made by Hudson (1953, 1959, 1961 a, and 1961 b) at the U.S. Army Engineer Waterways Experiment Station (WES), and a formula was developed to determine the stability of armor units on rubble structures. The stability formula, based on the results of extensive small-scale model testing and some preliminary verification by large-scale model testing is $$W = \frac{w_r H^3}{K_D (S_r - 1)^3 \cot \theta} \qquad (1)$$

where $W$ = weight in pounds of an individual armor unit in the primary cover layer. (When the cover layer is two quarry stones in thickness, the stones comprising the primary cover layer can range from about 0.75 W to 1.25 W with about 75 percent of the individual stones weighing more than W. The maximum weight of individual stones depends on the size or shape of the unit. The unit should not be of such a size as to extend an appreciable distance above the average level of the slope.)

$w_r$ = unit weight (saturated surface dry) of armor unit, lbs./ft.$^3$.

$H$ = design wave height at the structure site in feet.

$S_r$ = specific gravity of armor unit, relative to the water at the structure, ($S_r = w_r/w_\omega$ ).

$w_\omega$ = unit weight of water, fresh water = 62.4 lbs./ft.$^3$, seat water = 64.0 lbs./ft.$^3$.

$\theta$ = angle of structure slope measured from horizontal in degrees, and $K_D$ = stability coefficient that varies primarily with the shape of the armor units, roughness of the armor unit surface, sharpness of edges and degree of interlocking obtained in placement. (See Table I).

Equation I is intended for conditions when the crest of the structure is high enough to prevent major overtopping. Also the slope of the cover layer will be partly determined on the basis of stone sizes economically available.

life of the filter cloth to less than practical limits if exposed to usual sea or large lake wave occurrences.

The practical range of inside diameters of armor components used in a revetment system with a stone underlayer is from about 1 foot to about 6 feet. Components smaller than 1 foot inside diameter are too costly to manufacture per unit of revetment area. Components with inside diameters greater than 6 feet would require stone weighing 2 tons or more, since the largest dimension of stone in the underlayer should not be less than about one-half the inside diameter of the armor component. If components appreciably larger than 6 foot inside diameter are used the required size of the underlayer of stone would be sufficient to withstand the wave action without the armor layer of revetment components.

The revetment system can be composed of a series of nonattached rings if the conditions so warrant or attached loosely on diagonal tie rods where the conditions are more severe.

Normally the revetment system would extend to more than one wave height above to one wave height below the design water level with the rings being unattached. This would normally assure against severe over-topping or under-cutting. However, where undercutting of the revetment is anticipated or if conditions at the construction site preclude accurate placement of the revetment, tie rods positioned diagonally to the water line may be employed to preserve the integrity of the revetment layer. Where used, the tie rods should be sufficiently slack to permit the armor to drape over the undercut escarpment and thus forestall serious erosion.

A single diagonal tie rod system would normally be used where required. A crossed tie rod system would only be used where severe displacement of the revetment is anticipated and where dewatering of the site is

TABLE I

Suggested $K_D$ Values for Use in Determining Armor Unit Weight
No-Damage Criteria and Minor Overtopping

| | | | Structure Trunk | | Structure Head | | |
|---|---|---|---|---|---|---|---|
| | | | $K_D$ § | | $K_D$ | | Slope |
| Armor Units | n * | Placement | Breaking wave | Nonbreaking wave | Breaking wave | Nonbreaking wave | cot $\theta$ |
| Quarrystone | | | | | | | |
| Smooth rounded | 2 | random | 2.1 | 2.4 | 1.7 | 1.9 | 1.5 to 3.0 |
| Smooth rounded | >3 | random | 2.8 | 3.2 | 2.1 | 2.3 | ‖ |
| Rough angular | 1 | random† | † | 2.9 | † | 2.3 | ‖ |
| | | | | | 2.9 | 3.2 | 1.5 |
| Rough angular | 2 | random | 3.5 | 4.0 | 2.5 | 2.8 | 2.0 |
| | | | | | 2.0 | 2.3 | 3.0 |
| Rough angular | >3 | random | 3.9 | 4.5 | 3.7 | 4.2 | ‖ |
| Rough angular | 2 | special ‡ | 4.8 | 5.5 | 3.5 | 4.5 | ‖ |
| Tetrapod | | | | | 5.9 | 6.6 | 1.5 |
| and | 2 | random | 7.2 | 8.3 | 5.5 | 6.1 | 2.0 |
| Quadripod | | | | | 3.4 | 4.4 | 3.0 |
| | | | | | 8.3 | 9.0 | 1.5 |
| Tribar | 2 | random | 9.0 | 10.4 | 7.8 | 8.5 | 2.0 |
| | | | | | 7.0 | 7.7 | 3.0 |
| Dolos | 2 | random | 22.0¶ | 25.0¶ | 15.0 | 16.5 | 2.0£ |
| | | | | | 13.5 | 15.0 | 3.0 |
| Modified Cube | 2 | random | 6.8 | 7.8 | — | 5.0 | ‖ |
| Hexapod | 2 | random | 8.2 | 9.5 | 5.0 | 7.0 | ‖ |
| Tribar | 1 | uniform | 12.0 | 15.0 | 7.5 | 9.5 | ‖ |
| Quarrystone ($K_{RR}$) | | | | | | | |
| Graded angular | — | random | 2.2 | 2.5 | | | |

* n is the number of units comprising the thickness of the armor layer.

† The use of single layer of quarrystone armor units subject to breaking waves is not recommended, and only under special conditions for nonbreaking waves. When it is used, the stone should be carefully placed.

‡ Special placement with long axis of stone placed perpendicular to structure face.

§ Applicable to slopes ranging from 1 on 1.5 to 1 on 5.

‖ Until more information is available on the variation of $K_D$ value with slope, the use of $K_D$ shouldbe limited to slopes ranging from 1 on 1.5 to 1 on 3. Some armor units tested on a structure head indicate a $K_D$-slope dependence.

¶ Data only available for 1 on 2 slope.

£ Slopes steeper than 1 on 2 not recommended at the present time.

The dimensions of the rings will vary dependent upon the type of revetment being built as well as the conditions of the shoreline and waves, currents and oscillations to be handled. Where the revetment system involves a fairly smooth plane of cobbles or sandy material covered with filter cloth the practical range of the inside diameters of the armor components would range from about ½ foot to about 2 feet. Components of less than ½ foot diameter would not be effective except against very minor wave action. Components larger than 2 feet in diameter would allow excessive ballooning of the filter cloth which would shorten the effective feasible to allow access for threading of the crossed rods through the revetment system.

The features of the revetment components of the invention and their advantages are described in greater detail in the following description which should be read with reference to the accompanying drawings in which are illustrated by way of example different forms and uses of the blocks and in which.

Figure 2:
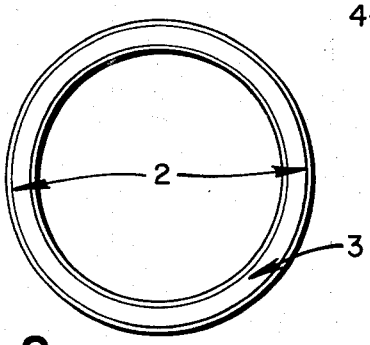
FIG. 2 is a plan view of one of the components of FIG. 1.
Figure 3:
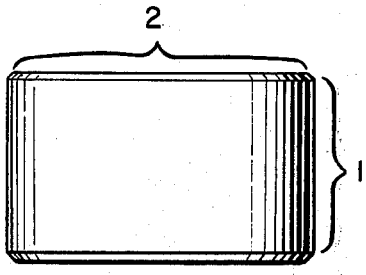
FIG. 3 is a side elevational view of the component of FIG. 2.
Figure 4:
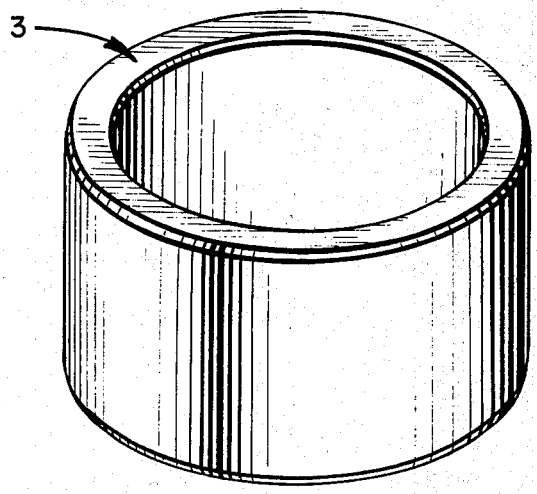
FIG. 4 is a perspective view of the component of FIG. 2.
Figure 5:
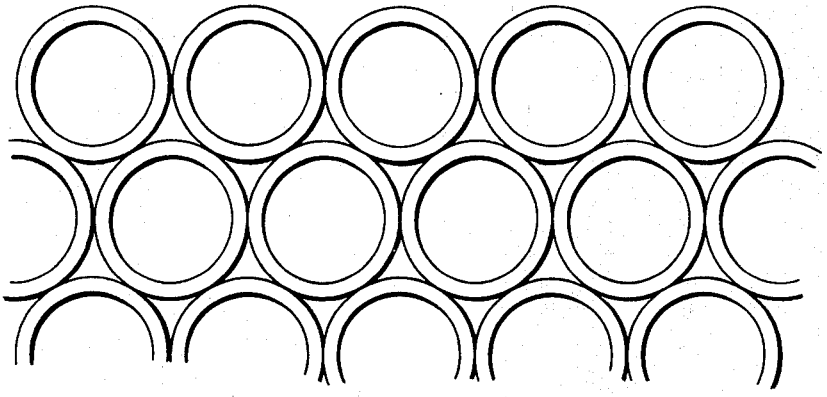
FIG. 5 is a partial plan view perpendicular to an armor layer of FIG. 1 composed of revetment components shown in FIG. 2.

Referring now particularly to FIGS. 2, 3 and 4, these show what will hereinafter be referred to as a "nami ring".

The nami ring has tubular form. The proportional height 1 of the nami ring being approximately half of the outside diameter 2. The exact proportion of the height to the diameter is carefully determined from test data, the character of the underlayer and site conditions. For example a high degree of unevenness of the underlay requires a proportionately greater height to diameter ratio such as one to one. The thickness of the wall 3 is about one-tenth of the outside diameter of a nami ring. The nami ring is preferably made of portland cement concrete of a density of about 150 lbs/ft$^3$, but could be fabricated of any material having suitable properties of hardness, strength and durability in the environment where it will be used. Very thin walls 3 of metal could be used. Corrugations around the circumference would permit use of even thinner metals.

Figure 1:
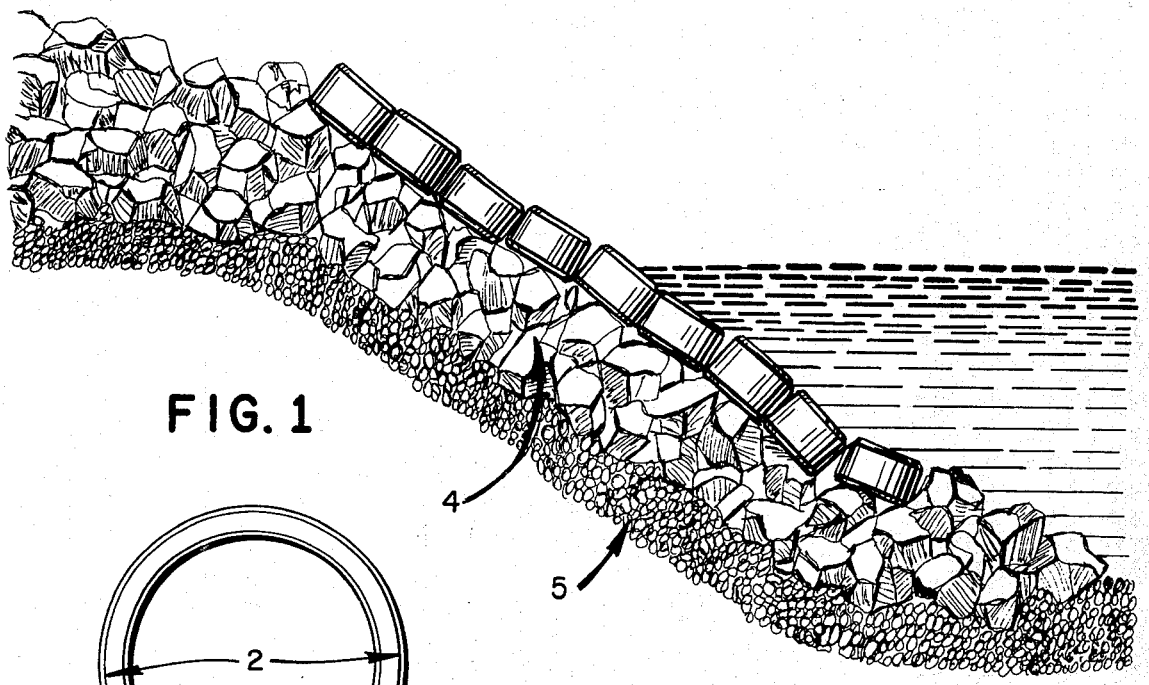
FIG. 1 is a vertical cross-sectional view of a revetment provided with an armor layer of revetment components constructed in accordance with the present invention.

In FIG. 1 is illustrated an example of a revetment exposed to hydrodynamic forces which are protected by an armor layer of nami rings constructed so that their characteristics are suitably adapted to a common type of revetment underlayers of stone 4 and 5. Design data and criteria for underlayers of stone in revetments are given in technical engineering publications.

Figure 6:
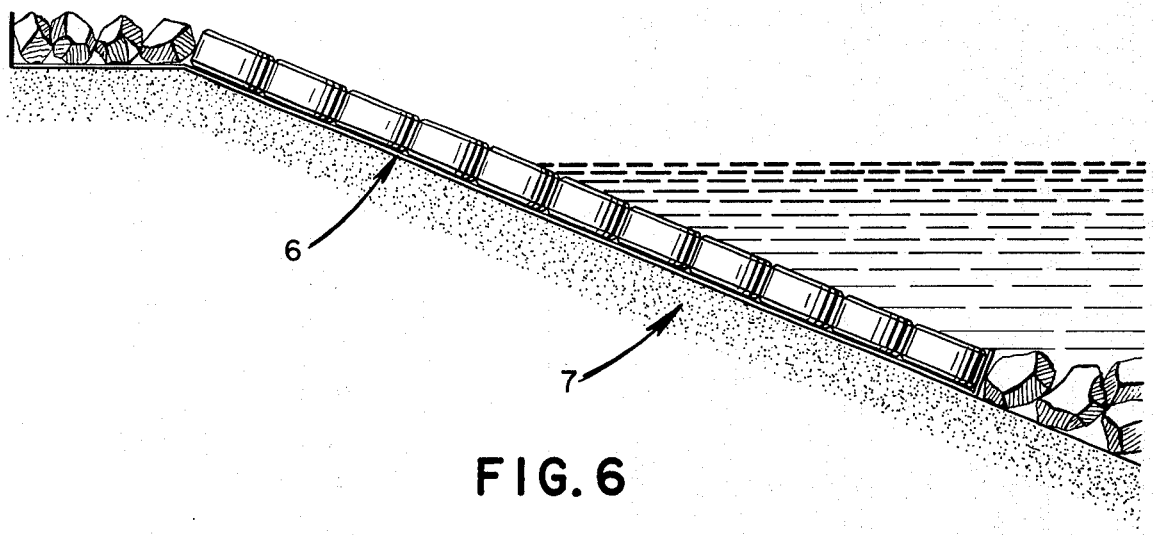
FIG. 6 is a vertical cross-sectional view of a revetted embankment provided with an armor layer of revetment components shown in FIG. 2.

In FIG. 6 is illustrated another example of a revetment exposed to hydrodynamic forces which are protected by an armor layer of nami rings constructed so that their characteristics are suitably adapted to a common type of filter cloth 6 on an embankment of granular soils 7.

Figure 7:
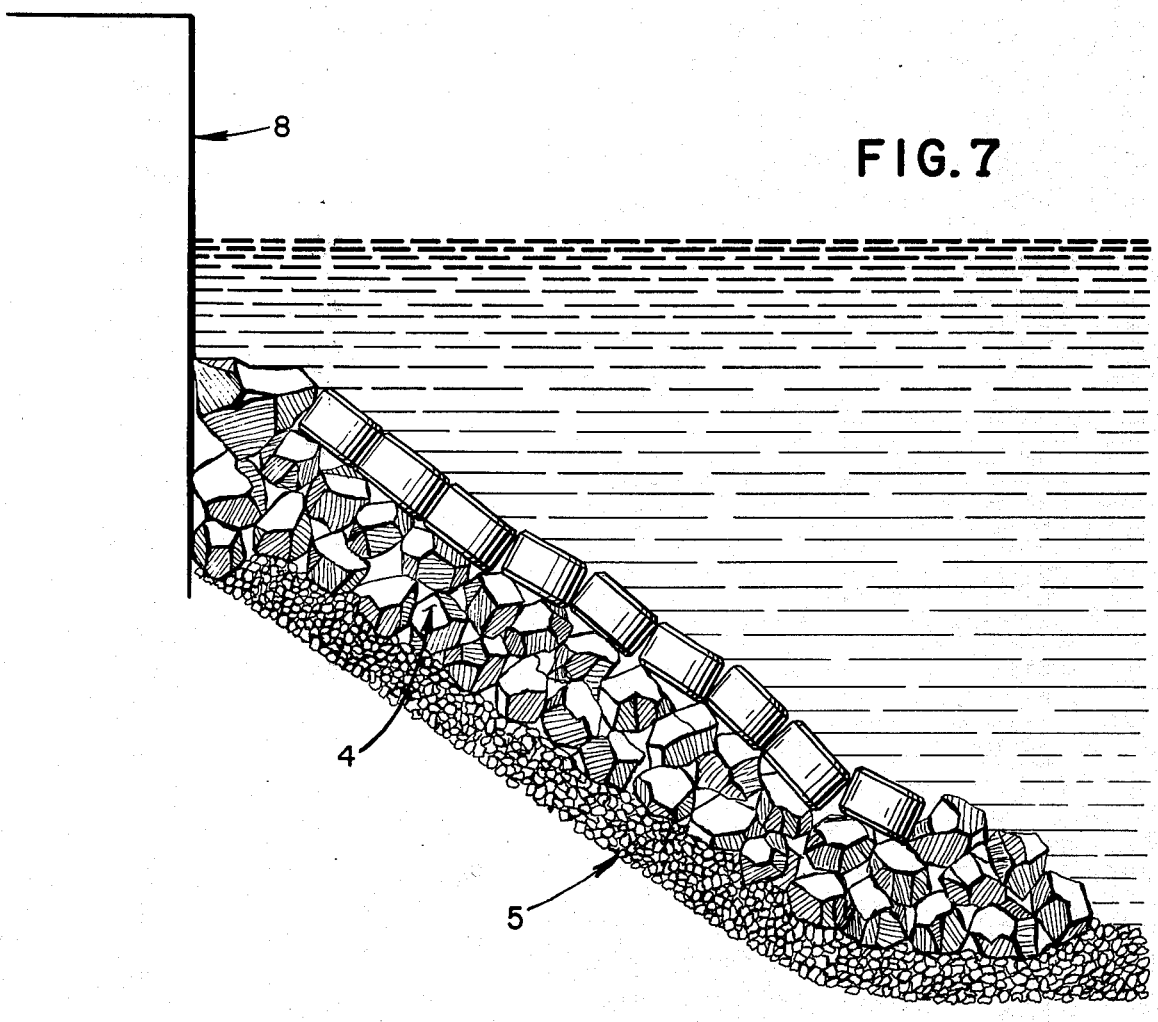
FIG. 7 is a vertical cross-sectional view of a bulkhead toe-protection provided with an armor layer of revetment components shown in FIG. 2 in accordance with the invention.

In FIG. 7 is illustrated another example of a revetment exposed to hydrodynamic forces which are protected by an armor layer of nami rings constructed so that their characteristics are suitably adapted for toe protection of a seawall or breakwater 8 caisson.

Figure 8:
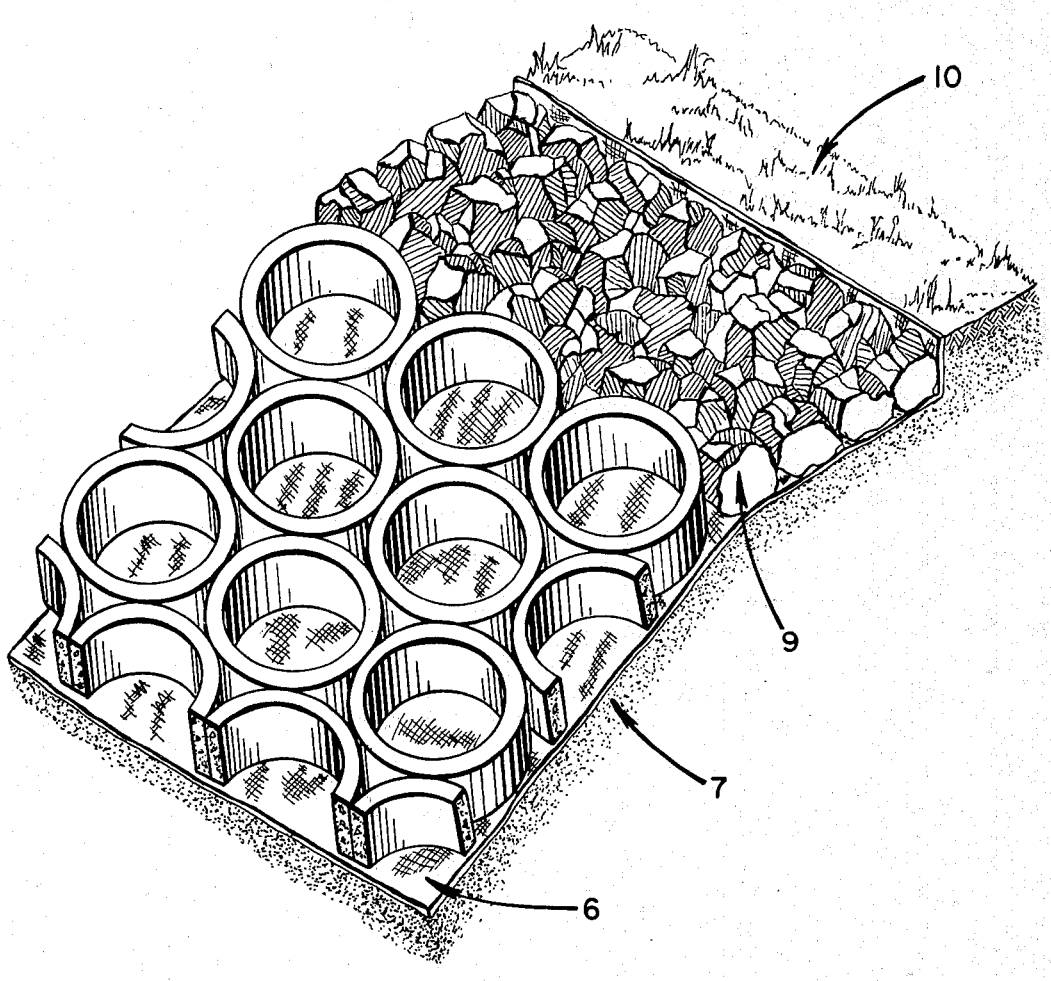
FIG. 8 is a partial perspective view of an armor layer composed of revetment components shown in FIG. 2.

In FIG. 8 is illustrated the upper portion of a revetment protected by an armor layer of nami rings adapted to a transition to stone 9 and vegetation 10 at the crest of an embankment.

Figure 9:
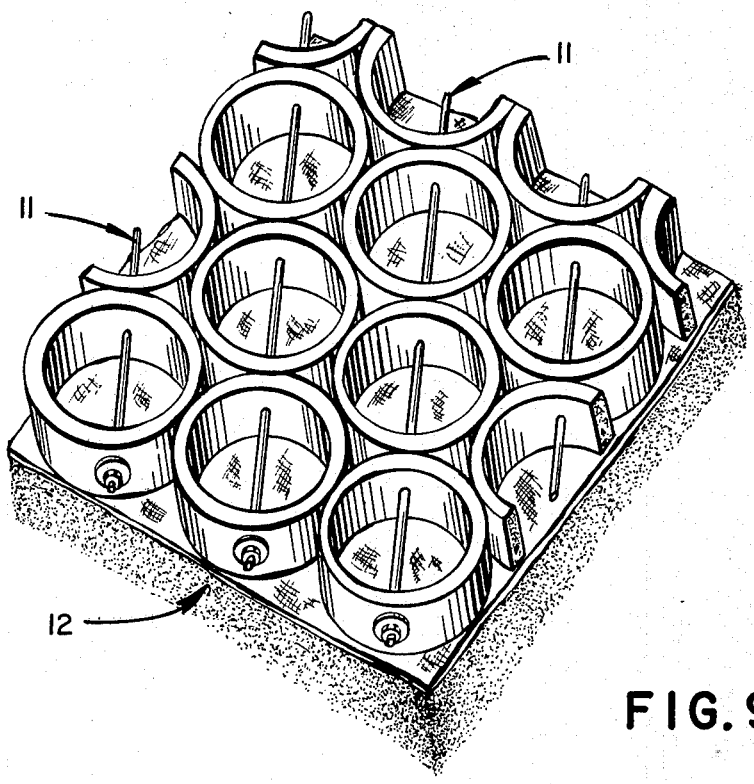
FIG. 9 is a partial perspective view of an armor layer composed of revetment components shown in FIG. 2 provided with eyelets shown in FIG. 10 with tie rods through diagonal rows of revetment components.

In FIG. 9 as illustrated the lower portion of a revetment protected by rows of nami rings secured by tie rods 11 for greater security if unusually low water levels permitted the hydrodynamic forces to erode and undercut the revetment 12.

Figure 10:
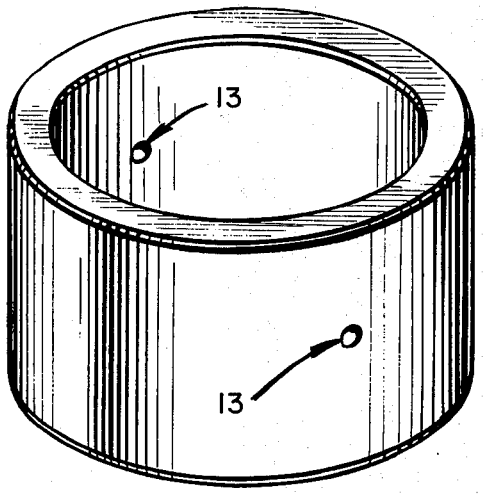
FIG. 10 is a perspective view of the revetment component shown in FIG. 2 with two eyelets to provide for diagonal tie rods.

In FIG. 10 is illustrated a nami ring provided with two eyelets 13 for a tie rod.

Figure 11:
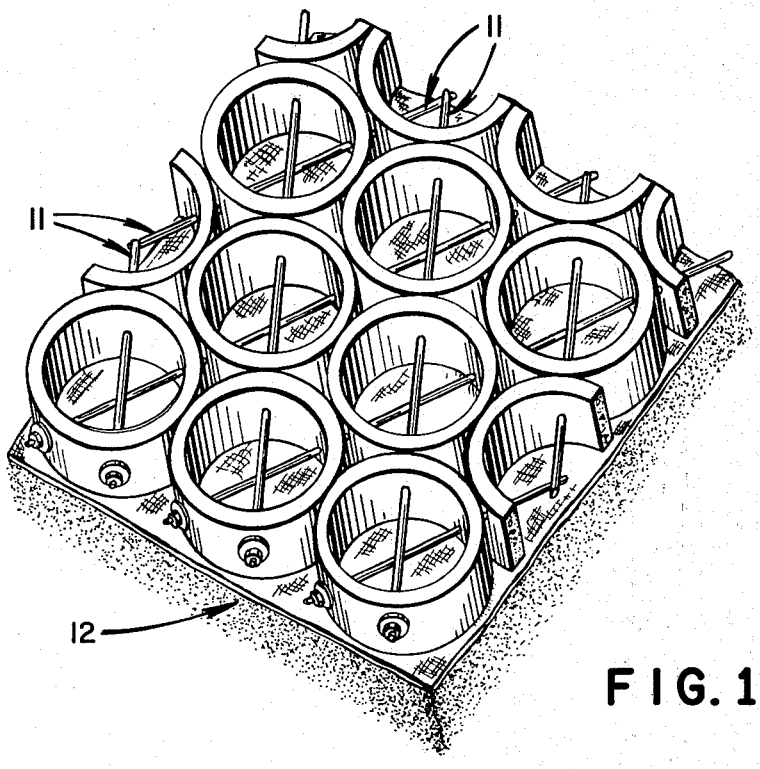
FIG. 11 is a partial perspective view of an armor layer composed of revetment components shown in FIG. 2 provided with eyelets shown in FIG. 12 with tie rods or lacing criss-crossed through diagonal rows of revetment components.

In FIG. 11 is illustrated a similar nami ring application as shown in FIG. 9 but with criss-crossed tie rods 11 or lacings such as polypropylene lines 11 to assure complete integrity of the armor layer in the event of undercutting 12.

Figure 12:
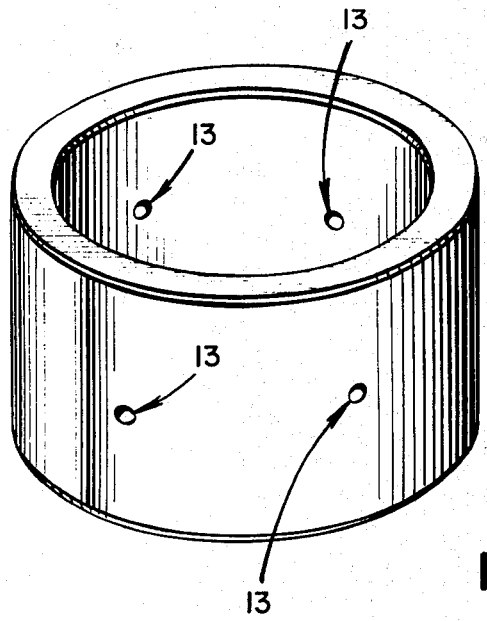
FIG. 12 is a perspective view of the revetment component shown in FIG. 2 with four eyelets to provide for criss-crossed tie rods or lacings.

In FIG. 12 is illustrated a nami ring provided with four eyelets for criss-crossed tie rods or lacings.

Model tests demonstrate that armor layers of nami rings tend to consolidate and pack tightly together when exposed to wave action. Each nami ring tends to have very firm lines of contact with two nami rings in the adjacent row above and two in the row adjacent below. Thus, the nami ring is not dependent on its weight or intricate interlocking, yet it has proven to provide a superior armor layer for a revetment, which tends to self heal.

The simple shape and proportions of the nami ring are readily produced by a common concrete pipe making machine, known as the Packer Head Concrete Pipe Making Machine. The placement pattern of FIGS. 5, 8, 9 and 11, of nami rings permit the economical use of a gang grab to place a complete row of nami rings at one time and other construction operations are readily performed by conventional construction equipment such as fork lifts.

From the foregoing full and complete disclosure it will be appreciated that a new and novel component for a revetment has been developed. The configuration and proportion of the component are critical for a versatile, economical component.

What is claimed is:

1. In a revetment system for exposure to waves, currents and oscillations of seas, lakes, streams and artificial channels, comprising an underlayer placed upon erosive material and a single layer of close-fitting frictionally contacting substantially uniformly patterned components placed on said underlayer the improvement wherein said components are short cylindrical tubes of uniform diameter having a length no more than the outside diameter, a uniform wall thickness of about five hundredths to about one-tenth the outside diameter to define a percentage of voids of 64 to 81% of the volume of the revetment with a stability co-efficient in excess of 25 and up to 45.

2. The system of claim 1, wherein the components have axes parallel to each other and are positioned to define diagonal rows with respect to the water line, said components in each row being loosely connected by a tie-rod passing diametrically therethrough.

3. The system of claim 2, wherein said components are interconnected by two crossing tie-rods passing diametrically therethrough.

4. The system of claim 1, wherein said underlayer is a filter cloth.

5. The system of claim 1, wherein said underlayer is composed of stone, said stone in contact with said component having its largest dimension not less than one-half of the inside diameter of the component.

6. The system of claim 1, wherein said underlayer is composed of stone of one grade over which is superimposed stone of a larger grade.

7. The system of claim 1, wherein said components have an inside diameter ranging from ½ foot to 6 feet.

8. The system of claim 6, wherein said components have an inside diameter ranging from 1 foot to 6 feet.

9. The system of claim 4, wherein said components have an inside diameter ranging from ½ foot to 2 feet.

10. The system of claim 1, wherein the tube length is about one-half the outside diameter.

* * * * *